US006629817B2

(12) United States Patent
Shelton et al.

(10) Patent No.: US 6,629,817 B2
(45) Date of Patent: Oct. 7, 2003

(54) SYSTEM AND METHOD FOR AIRFOIL FILM COOLING

(75) Inventors: Monty Lee Shelton, Loveland, OH (US); Thomas Tracy Wallace, Maineville, OH (US); Robert Alan Frederick, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/899,305

(22) Filed: Jul. 5, 2001

(65) Prior Publication Data

US 2003/0007864 A1 Jan. 9, 2003

(51) Int. Cl.[7] ..... F01D 5/18
(52) U.S. Cl. ..... 415/115; 416/97 R; 29/889.721
(58) Field of Search ..... 415/115; 416/90 R, 416/91, 96 R, 97 R, 97 A, 175, 228, 232, 223 A; 29/889.72, 889.721

(56) References Cited

U.S. PATENT DOCUMENTS 5,281,084 A 1/1994 Noe et al.
5,458,461 A 10/1995 Lee et al.
5,779,437 A * 7/1998 Abdel-Messeh et al. .... 415/115
5,813,836 A * 9/1998 Starkweather ..... 416/97 R X
5,931,636 A 8/1999 Savage et al.
6,164,912 A * 12/2000 Tabbita et al. ..... 416/97 R
6,241,468 B1 * 6/2001 Lock et al. ..... 415/115
2002/0172596 A1 * 11/2002 Kohli et al. ..... 416/97 R X

OTHER PUBLICATIONS

Webster's Third New International Dictionary, Unabridged, Copyright 1993 Merriam–Webster, Incorporated.*

* cited by examiner

*Primary Examiner*—Edward K. Look
*Assistant Examiner*—Richard A. Edgar
(74) *Attorney, Agent, or Firm*—William Scott Andes; Armstrong Teasdale LLP; Robert B. Reeser, III

(57) ABSTRACT

An airfoil for a gas turbine engine including an inflection that facilitates enhancing film cooling of the airfoil, without adversely affecting aerodynamic efficiency of airfoil is described. The airfoil includes a generally concave first sidewall and a generally convex second sidewall joined at a leading edge and at a trailing edge of the airfoil. A plurality of cooling openings extend between an internal cooling chamber and an external surface of the first sidewall. One cooling opening extends from the cooling chamber into the inflection at a relatively shallow injection angle with respect the airfoil external surface.

13 Claims, 3 Drawing Sheets

SYSTEM AND METHOD FOR AIRFOIL FILM COOLING

STATEMENT REGARDING FEDERALLY SPONSORED RESEARCH & DEVELOPMENT

This invention was made with Government support under Contract No. F33615-92-C-2204 and Contract No. F33615-92-C-2278 awarded by the U.S. Air Force. The Government has certain rights in this invention.

BACKGROUND OF THE INVENTION

This application relates generally to gas turbine engines and, more particularly, to methods and apparatus for cooling airfoils used within gas turbine engines.

At least some known gas turbine engines include a compressor, a combustor, and a turbine. Airflow entering the compressor is compressed and directed to the combustor where it is mixed with fuel and ignited, producing hot combustion gases used to drive the turbine. Because components within the turbine are exposed to hot combustion gases, cooling air is routed to the airfoils and blades.

For example, a turbine vane or rotor blade typically includes a hollow airfoil, the outside of which is exposed to the hot combustion gases, and the inside of which is supplied with cooling fluid, which is typically compressed air. The airfoil includes leading and trailing edges, a pressure side, and a suction side. The pressure and suction sides connect at the airfoil leading and trailing edges, and span radially between an airfoil root and an airfoil tip. Film cooling holes extend between a cooling chamber defined within the airfoil and an outer surface of the airfoil. The cooling holes route cooling fluid from the cooling chamber to the outside of the airfoil for film cooling the airfoil. The film cooling holes discharge cooling fluid at an injection angle that is measured with respect to the outer surface of the airfoil.

Because of the curvature distribution of the outer surface of the airfoil between the leading and trailing edges, the injection angles of the cooling holes are typically between 25 and 40 degrees. Cooling fluid discharged from cooling holes having increased injection angles may separate from the surface of the airfoil and mix with the hot combustion gases. Such separation decreases an effectiveness of the film cooling and increases aerodynamic mixing losses.

To facilitate reducing aerodynamic mixing losses, at least some known airfoils include curved film cooling openings. The curved film cooling openings have injection angles as low as 16.5 degrees. However, the cooling fluid may separate from an inner wall of the cooling opening and be discharged in an erratic manner. Furthermore, manufacturing such curved openings is a complex and costly procedure.

BRIEF SUMMARY OF THE INVENTION

In an exemplary embodiment, an airfoil for a gas turbine engine includes an inflection that facilitates enhancing film cooling of the airfoil, without adversely impacting aerodynamic efficiency of the airfoil. The airfoil includes a generally concave first sidewall and a generally convex second sidewall. The sidewalls are joined at a leading edge and at a chordwise spaced trailing edge of the airfoil that is downstream from leading edge. A cooling chamber is defined within the sidewalls, and a plurality of cooling openings extend between the cooling chamber and an external surface of the first sidewall. At least one of the cooling openings extends from the cooling chamber into the inflection at an injection angle measured with respect to an external surface of the airfoil.

In another aspect, a gas turbine engine including a plurality of airfoils that each include a leading edge, a trailing edge, a first sidewall having an outer surface, and a second sidewall having an outer surface is provided. The airfoil first and second sidewalls are connected chordwise at the leading and trailing edges. The first and second sidewalls extend radially from an airfoil root to an airfoil tip, and at least one of the first sidewall and said second sidewall also includes an inflection.

In a further aspect, a method for contouring an airfoil for a gas turbine engine to facilitate improving film cooling effectiveness of the airfoil is provided. The airfoil includes a leading edge, a trailing edge, a first sidewall, and a second sidewall. The first and second sidewalls are connected chordwise at the leading and trailing edges to define a cavity, and extend radially between an airfoil root and an airfoil tip. The method includes the steps of forming an inflection in an outer surface of at least one of the airfoil first sidewall and the airfoil second sidewall, such that the inflection extends a distance radially between the airfoil root and the airfoil tip, and forming at least one opening within the inflection for receiving cooling fluid therethrough from the airfoil cavity to the airfoil outer surface.

DETAILED DESCRIPTION OF THE INVENTION

Figure 1:
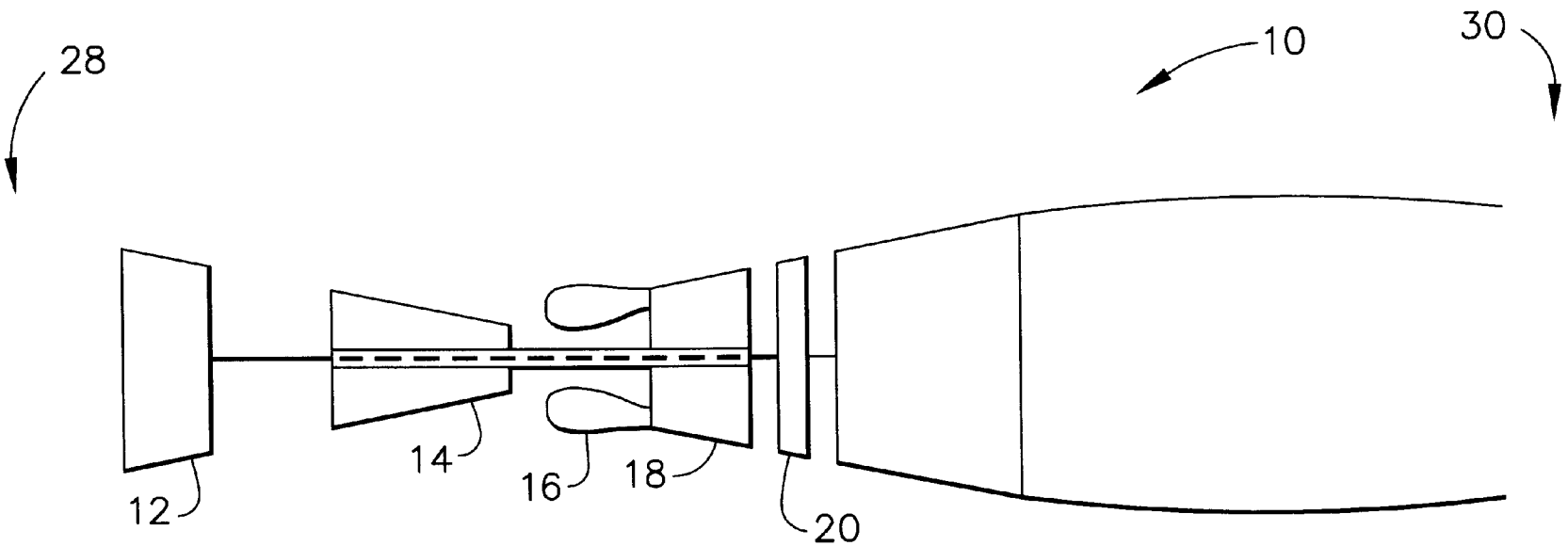
FIG. 1 is schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, and a low pressure turbine 20. Engine 10 has an intake side 28 and an exhaust side 30. In one embodiment, engine 10 is a CFM 56 engine commercially available from General Electric Corporation, Cincinnati, Ohio.

In operation, air flows through fan assembly 12 and compressed air is supplied to high pressure compressor 14. The highly compressed air is delivered to combustor 16. Airflow (not shown in FIG. 1) from combustor 16 drives turbines 18 and 20, and turbine 20 drives fan assembly 12.

Figure 2:
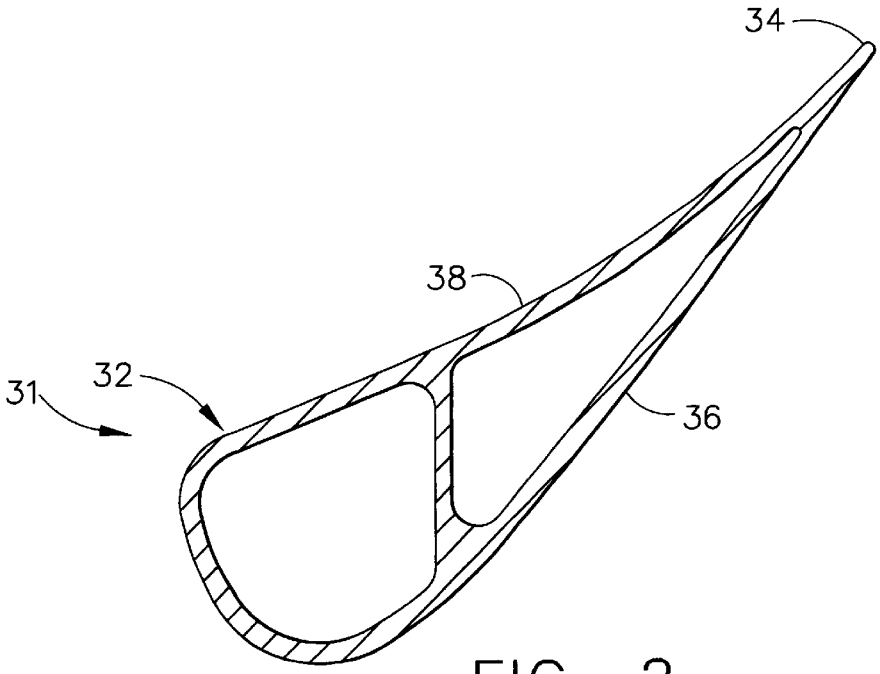
FIG. 2 (PRIOR ART)
FIG. 2 is a cross sectional view of a known airfoil that may be used with the gas turbine engine shown in FIG. 1.

FIG. 2 is a cross sectional view of a known airfoil 31 including a leading edge 32 and a chord-wise spaced trailing edge 34 that is downstream from leading edge 32. Airfoil 31 is hollow and includes a first sidewall 36 and a second sidewall 38. First sidewall 36 is generally convex and defines a suction side of airfoil 31, and second sidewall 38 is generally concave and defines a pressure side of airfoil 31. Sidewalls 36 and 38 are joined at airfoil leading and trailing edges 32 and 34. More specifically, first sidewall 36 is curved and aerodynamically contoured to join with second sidewall 38 at leading edge 32.

Figure 3:
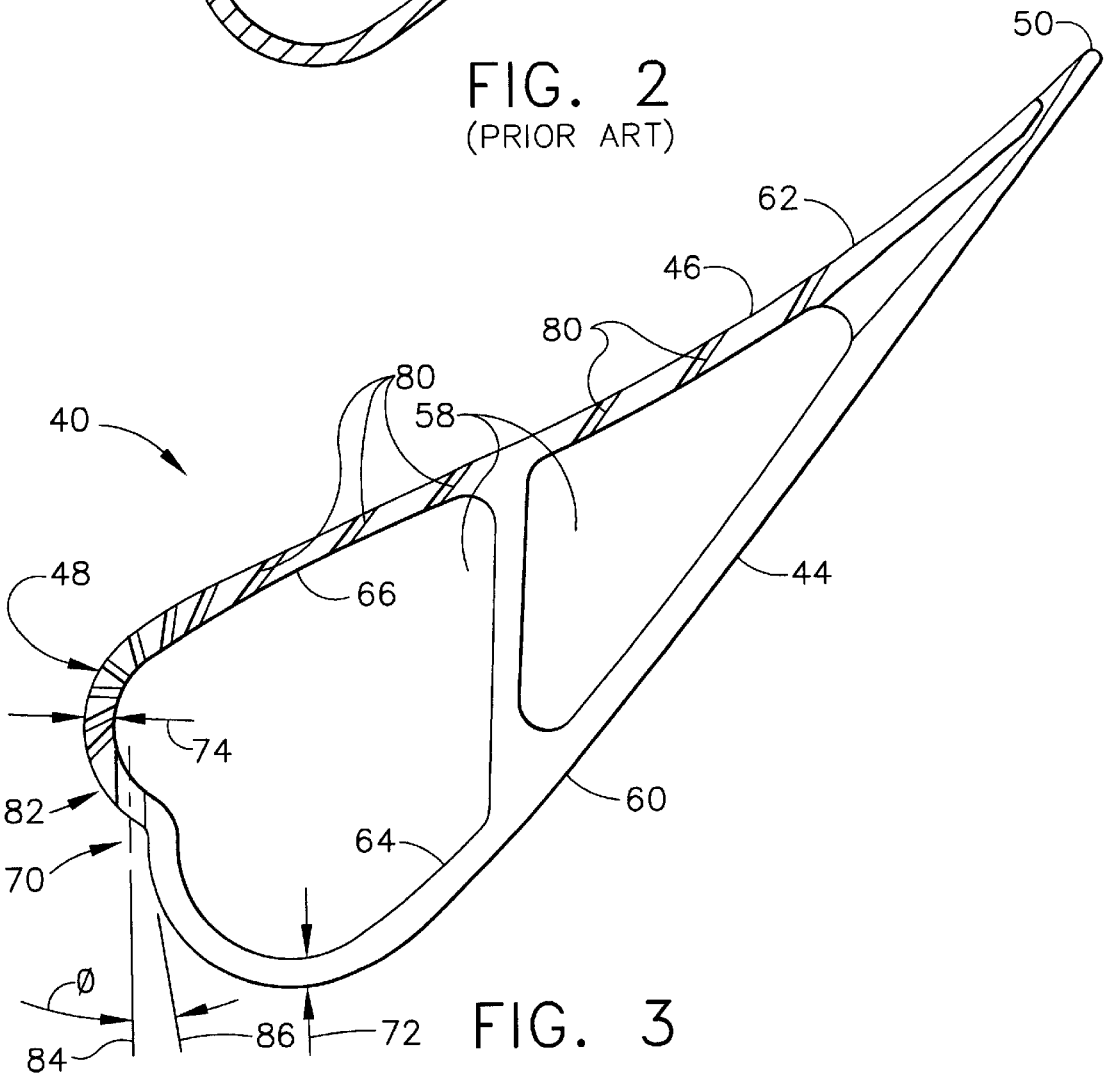
FIG. 3 is a cross sectional view of an airfoil that may be used with the gas turbine engine shown in FIG. 1.

FIG. 3 is a cross sectional view of an airfoil 40 that may be used with a gas turbine engine, such as engine 10, shown in FIG. 1. In one embodiment, airfoil 40 is used within a plurality of rotor blades (not shown) that form a high pressure turbine rotor blade stage (not shown) of the gas turbine engine. In another embodiment, airfoil 40 is used within a plurality of turbine vanes (not shown) used to direct a portion of a gas flow path from a combustor, such as combustor 16, shown in FIG. 1, onto annular rows of rotor blades.

Airfoil 40 is hollow and includes a first sidewall 44 and a second sidewall 46. First sidewall 44 is generally convex and defines a suction side of airfoil 40, and second sidewall 46 is generally concave and defines a pressure side of airfoil 40. Sidewalls 44 and 46 are joined at a leading edge 48 and at a chordwise spaced trailing edge 50 of airfoil 40 that is downstream from leading edge 48.

First and second sidewalls 44 and 46, respectively, extend longitudinally or radially outward to span from an airfoil root (not shown) to an airfoil tip (not shown) which defines a radially outer boundary of an internal cooling chamber 58. Cooling chamber 58 is further defined within airfoil 40 between sidewalls 44 and 46. Internal cooling of airfoils 40 is known in the art. In one embodiment, cooling chamber 58 includes a serpentine passage (not shown) cooled with compressor bleed air.

First and second sidewalls 44 and 46, respectively, each have a relatively continuous arc of curvature between airfoil leading and trailing edges 48 and 50, respectively. Additionally, each sidewall 44 and 46, includes an outer surface 60 and 62, respectively, and an inner surface 64 and 66, respectively. Each sidewall inner surface 64 and 66 is adjacent to cooling chamber 58.

Airfoil 40 also includes an inflection or an area of localized surface contouring 70. More specifically, near airfoil leading edge region 48, sidewall 44 is contoured to form inflection 70, such that a thickness 72 of sidewall 44 remains substantially constant through inflection 70. In an alternative embodiment, either sidewall 44 or 46, or both sidewalls 44 and 46, are contoured to form inflection 70. In a further embodiment, sidewall thickness' 72 and 74 are variable through inflection 70. Inflection 70 extends substantially longitudinally or radially between the airfoil root and the airfoil tip.

A plurality of cooling openings 80 extend between cooling chamber 58 and airfoil outer surfaces 60 and 62 to connect cooling chamber 58 in flow communication with airfoil outer surfaces 60 and 62. In one embodiment, each cooling opening 80 has a substantially circular diameter. Cooling openings 80 discharge cooling fluid through fluid paths known as injection jets. Alternatively, each cooling opening 80 is non-circular. At least one cooling opening 82 extends between airfoil outer surface 60 and cooling chamber 58 within inflection 70. More specifically, inflection cooling opening 82 has a centerline 84, and extends through sidewall 44 at an injection angle Ø. Injection angle Ø is formed by an intersection of centerline 84 and a line 86 that is tangent to airfoil outer surface 60 at a point where cooling opening 82 intersects airfoil outer surface 60. In one embodiment, injection angle Ø is less than approximately 16 degrees.

During operation, although the curvature of airfoil sidewalls 44 and 46 is advantageous in directing combustion gases, contact with the combustion gases increases a temperature of airfoils 40. To facilitate cooling airfoil 40, cooling fluid is routed through cooling openings 80 and used in film cooling airfoil outer surfaces 60 and 62. The injection of cooling fluid into a boundary layer, known as film cooling, produces an insulating layer or film between airfoil outer surfaces 60 and 62, and the hot combustion gases flowing past airfoil 40.

Because airfoil inflection 70 permits cooling fluid to be provided to airfoil outer surface 60 through inflection cooling opening 82 at a relatively shallow injection angle Ø, a reduction in coolant injection jet separation is facilitated, therefore enhancing film cooling effectiveness. Furthermore, because inflection 70 facilitates enhancing film cooling effectiveness, reduced amounts of cooling fluid for a set amount of heat transfer may be utilized. Alternatively, because inflection 70 facilitates enhancing film cooling effectiveness, a useful life of airfoil 40 may be facilitated to be extended. Furthermore, aerodynamic losses associated with inflection 70 are facilitated to be reduced because inflection cooling opening 82 injects cooling fluid at a shallow injection angle Ø, and thus buffers the inflection.

Figure 4:
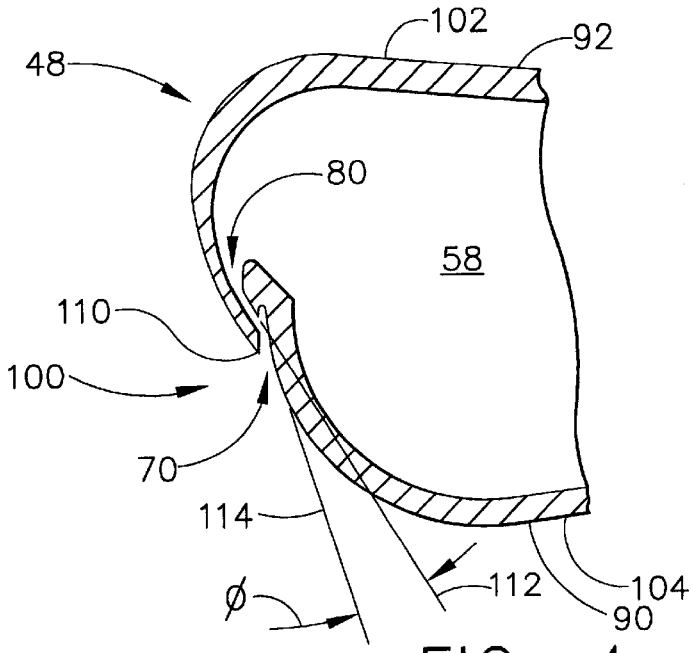
FIG. 4 is a partial cross sectional view of an alternative embodiment of an airfoil that may be used with the gas turbine engine shown in FIG. 1.

FIG. 4 is a partial cross sectional view of an alternative embodiment of an airfoil 100 that may be used with gas turbine engine 10 shown in FIG. 1. Airfoil 100 is substantially similar to airfoil 40 shown in FIG. 3 and components in airfoil 100 that are identical to components of airfoil 40 are identified in FIG. 3 using the same reference numerals used in FIG. 3. Accordingly, airfoil 100 includes leading edge 48, inflection 70, and cooling chamber 58. Airfoil 100 also includes a first sidewall 102 and a second sidewall 104. Sidewalls 102 and 104 define cooling chamber 58 and are substantially similar to sidewalls 46 and 44, shown in FIG. 3.

A plurality of cooling openings 80 extend from cooling chamber 58 and airfoil outer surfaces 90 and 92 to connect cooling chamber 58 in flow communication with airfoil outer surfaces 90 and 92. At least one cooling opening 110 extends between airfoil outer surface 90 and cooling chamber 58 within inflection 70. More specifically, inflection cooling opening 110 has a centerline 112 and extends through sidewall 104 at an injection angle Ø. Injection angle Ø is formed by an intersection of centerline 112 and a line 114 that is tangent to airfoil outer surface 90 at a point where cooling opening 110 intersects airfoil outer surface 90. In one embodiment, injection angle Ø is less than approximately 16 degrees. More specifically, because inflection cooling opening 110 extends through sidewall 104, injection angle Ø is negative with respect to airfoil outer surface 90. In an alternative embodiment, injection angle Ø is approximately equal to zero degrees.

During operation, because airfoil inflection 70 permits cooling fluid to be provided to airfoil outer surface 90 through inflection cooling opening 110 at a relatively shallow injection angle Ø, a reduction in injection jet separation is facilitated, thus enhancing film cooling effectiveness. Furthermore, because inflection 70 facilitates enhancing film cooling effectiveness, reduced amounts of cooling fluid for a set amount of heat transfer may be utilized. Alternatively, because inflection 70 facilitates enhancing film cooling effectiveness, a useful life of airfoil 100 may be facilitated to be extended.

Figure 5:
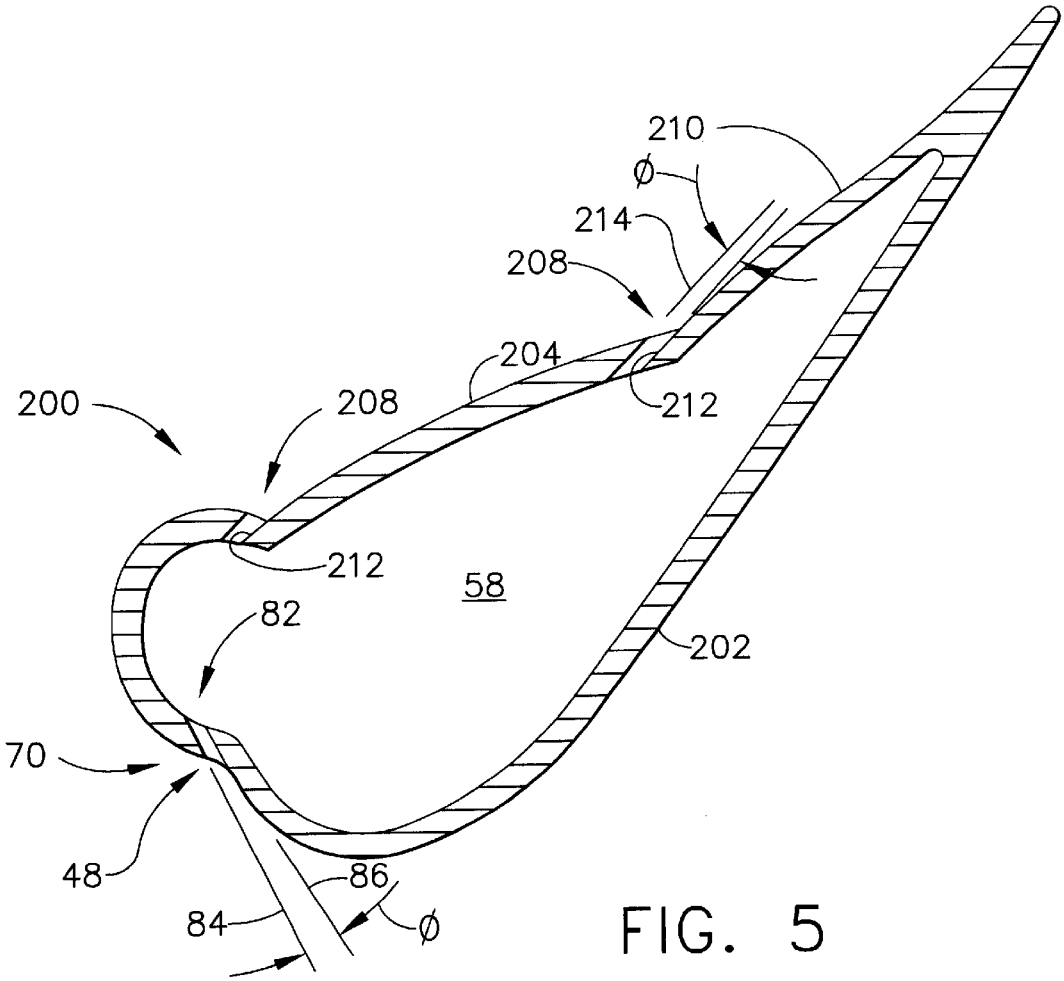
FIG. 5 is a cross sectional view of a further alternative embodiment of an airfoil that may be used with the gas turbine engine shown in FIG. 1.

FIG. 5 is a cross sectional view of an alternative embodiment of an airfoil 200 that may be used with a gas turbine engine, such as gas turbine engine 10, shown in FIG. 1. Airfoil 200 is substantially similar to airfoil 40 shown in FIG. 3 and components in airfoil 200 that are identical to components of airfoil 40 are identified in FIG. 3 using the same reference numerals used in FIG. 3. Accordingly, airfoil 200 includes leading edge 48, inflection 70, and cooling chamber 58. Airfoil 200 also includes a first sidewall 202 and a second sidewall 204. Sidewalls 202 and 204 define cooling chamber 58 and are substantially similar to sidewalls 44 and 46, shown in FIG. 3, but sidewall 204 includes a plurality of inflections 208. Inflections 208 extend longitudinally or radially between an airfoil root (not shown) and an airfoil tip (not shown), and are substantially similar to inflection 70, but are formed within sidewall 204.

At least one cooling opening 82 extends from cooling chamber 58 into inflection 70. In an alternative embodiment, cooling opening 82 extends through either pressure side sidewall 202 or suction side sidewall 204. More specifically, inflection cooling opening 82 has a centerline 84, and extends through sidewall 202 at an injection angle Ø. Injection angle Ø is formed by an intersection of centerline 84 and tangential line 86. In one embodiment, injection angle Ø is less than approximately 16 degrees.

A plurality of cooling openings 212 extend between cooling chamber 58 and airfoil outer surface 210 to connect cooling chamber 58 in flow communication with airfoil outer surface 210. More specifically, each cooling opening 212 extends between airfoil outer surface 210 and cooling chamber 58 within a respective inflection 208. More specifically, each cooling opening 212 has a centerline 214, and extends through sidewall 204 at injection angle Ø. In one embodiment, each injection angle Ø is less than approximately 16 degrees. Each cooling opening 212 has a substantially circular diameter. Alternatively, cooling openings 212 are non-circular. In one embodiment, cooling openings 212 are cast with airfoil sidewall 204 and are not manufactured after casting of airfoil 200. In another embodiment, cooling openings 212 are machined into airfoil 200.

During operation, a velocity of combustion gases at and across airfoil leading edge 48 and airfoil pressure side sidewall 204 is relatively low in comparison to a velocity of the combustion gases across airfoil suction side sidewall 202. As a result, low mach number velocity regions develop spaced axially from airfoil leading edge 48 along airfoil sidewall 204, and higher mach number velocity regions develop downstream from leading edge 48 along airfoil sidewall 202. Although film blowing ratios are typically higher in an airfoil low mach number velocity regions, because inflections 70 and 208 are formed within the airfoil low mach number velocity regions of airfoil 200, cooling fluid is injected from cooling openings 82 and 212, respectively, at a relatively shallow injection angle, and a reduction in film cooling separation is facilitated along airfoil suction sidewall 204. In addition, because cooling fluid flow and injection angle are reduced along airfoil sidewall 202, aerodynamic mixing losses are facilitated to be reduced.

The above-described airfoil includes at least one inflection and a cooling opening within the inflection. The inflection enables the inflection to extend from the cooling chamber with a relatively shallow injection angle to facilitate reducing aerodynamic mixing losses, and enhance film cooling effectiveness. As a result, enhanced film cooling facilitates extending a useful life of the airfoil in a cost-effective and reliable manner.

While the invention has been described in terms of various specific embodiments, those skilled in the art will recognize that the invention can be practiced with modification within the spirit and scope of the claims.

What is claimed is:

1. A method for contouring an airfoil for a gas turbine engine to facilitate improving film cooling effectiveness of the airfoil, the airfoil including a leading edge, a trailing edge, a first sidewall, and a second sidewall, the first and second sidewalls connected chordwise at the leading and trailing edges to define a cavity, the first and second sidewalls extending radially between an airfoil root to an airfoil tip, said method comprising the steps of:

forming an inflection in an outer surface of at least one of the airfoil first sidewall and the airfoil second sidewall, such that the inflection extends a distance radially between the airfoil root and the airfoil tip and such that the inflection is a distance downstream from the stagnation line of the leading edge of the airfoil, wherein the inflection is defined between a concave surface and a convex surface; and forming at least one opening immediately adjacent the inflection and through at least one of the convex surface and the concave surface immediately upstream of the inflection point of the inflection for receiving cooling fluid therethrough from the airfoil cavity to the airfoil outer surface wherein said opening through the airfoil sidewall is at an injection angle measured with respect to the airfoil outer surface that is less than about 16 degrees.

2. A method in accordance with claim 1 wherein said step of extending each opening further comprises the step of extending each opening through the airfoil sidewall at an injection angle to reduce cooling flow to at least one of the airfoil first sidewall and the airfoil second sidewall.

3. A method in accordance with claim 1 wherein said step of forming an inflection in an outer surface further comprises the step of forming a plurality of inflections in the airfoil outer surface.

4. A method in accordance with claim 3 wherein the airfoil first side wall is substantially concave, and the airfoil second sidewall is substantially convex, said step of forming a plurality of inflections further comprises the steps of:

forming at least one inflection in close proximity to the airfoil leading edge with, and forming at least one inflection within the airfoil second sidewall.

5. An airfoil for a gas turbine engine, said airfoil comprising:

a leading edge;

a trailing edge;

a first sidewall extending in radial span between an airfoil root and an airfoil tip, said first sidewall comprising an outer surface;

a second sidewall connected to said first sidewall at said leading edge and said trailing edge, said second sidewall comprising an outer surface, and extending in radial span between the airfoil root and the airfoil tip, at least one of said first sidewall and said second side wall further comprising an inflection defined between a concave surface and a convex surface such that the inflection is a distance downstream of the stagnation line of the leading edge of the airfoil, at least one of said first sidewall and said second sidewall comprising at least one cooling opening extending therethrough immediately adjacent and upstream of the inflection point of said inflection, said at least one cooling opening configured to receive cooling fluid therethrough, wherein said at least one cooling opening is configured at an injection angle measured with respect to the airfoil outer surface that is less than about 16 degrees.

6. An airfoil in accordance with claim 5 wherein each said cooling opening configured to reduce cooling flow to at least one of said airfoil first sidewall and said airfoil second sidewall.

7. An airfoil in accordance with claim 5 wherein said airfoil first sidewall comprises a plurality of inflections, at least one of said inflections in close proximity to said airfoil leading edge.

8. An airfoil in accordance with claim 7 wherein said airfoil first sidewall is substantially concave, said airfoil second sidewall is substantially convex.

9. A gas turbine engine comprising a plurality of airfoils, each said airfoil comprising a leading edge, a trailing edge, a first sidewall comprising an outer surface, and a second sidewall comprising an outer surface, said airfoil first and second sidewalls connected chordwise at said leading and trailing edges, said first and second sidewalls extending radially from an airfoil root to an airfoil tip, at least one of said first sidewall and said second sidewall further comprising an inflection defined between a convex surface and a concave surface, wherein said inflection is a distance downstream of the stagnation line of the leading edge of the airfoil, at least one of said airfoil first and second sidewalls further comprises an opening extending therethrough immediately adjacent and upstream of the inflection point of said inflection, wherein said at least one cooling opening is configured at an injection angle measured with respect to the airfoil outer surface that is less than about 16 degrees.

10. A gas turbine engine in accordance with claim 9 wherein each said airfoil first sidewall is substantially concave, each said airfoil second sidewall is substantially convex.

11. A gas turbine engine in accordance with claim 10 wherein said airfoil first and second sidewalls define a cavity, said sidewall opening extending from said airfoil cavity to said airfoil outer surface.

12. A gas turbine engine in accordance with claim 11 wherein each said airfoil sidewall opening configured to reduce cooling flow from said airfoil cavity to at least one of said airfoil first and second sidewalls.

13. A gas turbine engine in accordance with claim 11 wherein at least one of said airfoil first and second sidewalls further comprises a plurality of inflections, at least one of said inflections in close proximity to said airfoil leading edge.

* * * * *